US005113811A

United States Patent [19]

Rembold et al.

[11] Patent Number: 5,113,811

[45] Date of Patent: May 19, 1992

[54] HYDRAULIC VALVE CONTROL DEVICE FOR INTERNAL COMBUSTION ENGINES

[75] Inventors: Helmut Rembold, Stuttgart; Ernst Linder, Mühlacker, both of Fed. Rep. of Germany

[73] Assignee: Robert Bosch GmbH, Stuttgart, Fed. Rep. of Germany

[21] Appl. No.: 700,126

[22] PCT Filed: Oct. 25, 1990

[86] PCT No.: PCT/DE90/00807

§ 371 Date: May 28, 1991

§ 102(e) Date: May 28, 1991

[30] Foreign Application Priority Data

Nov. 25, 1989 [DE] Fed. Rep. of Germany ..... 3939003

[51] Int. Cl.[5] ..... F01L 9/02; F01L 1/12

[52] U.S. Cl. ..... 123/90.12; 123/90.16; 123/90.48

[58] Field of Search ..... 123/90.12, 90.13, 90.15, 123/90.16, 90.27, 90.48, 90.49, 90.55

[56] References Cited

U.S. PATENT DOCUMENTS

| | | | |
|---|---|---|---|
| 4,164,917 | 8/1979 | Glasson | 123/90.16 |
| 4,218,995 | 8/1980 | Aoyama | 123/90.16 |
| 4,452,186 | 6/1984 | List et al. | 123/90.55 |
| 4,671,221 | 6/1987 | Geringer et al. | 123/90.12 |

*Primary Examiner*—E. Rollins Cross
*Assistant Examiner*—Weilun Lo
*Attorney, Agent, or Firm*—Edwin E. Greigg; Ronald E. Greigg

[57] ABSTRACT

A hydraulic valve control with a (hydraulic) fluid reservoir allocated to a pressure chamber of a magnetic lifter, with a reservoir piston, reservoir, and reservoir spring, in which the pressure chamber is arranged between a cam piston actuated by the driving cam and a valve piston, the latter acting in conjunction with the engine valve, and in which the cam piston is configured as a hollow piston, in the cavity of which the fluid reservoir is arranged.

27 Claims, 2 Drawing Sheets

HYDRAULIC VALVE CONTROL DEVICE FOR INTERNAL COMBUSTION ENGINES

STATE OF TECHNOLOGY

The invention is based on a hydraulic valve control device for internal combustion engines. In principle, such an electrohydraulic control device must satisfy several requirements. There is, on the one hand, very little free space available in the vicinity of the cylinder head of an internal combustion engine, therefore all components located there should have as small as possible dimensions. On the other hand, this is an area which is subject to becoming relatively hot, a factor which needs to be remembered when designing and configuring components, in particular moving parts. It is of decisive importance for the quality of the control that the oil which is moved to and fro should be as small as possible, since the oil which is shunted to and fro has an effect, due to cross-section control, on the quality of the precision of the control or the compressibility of the controlling oil, which is of course of particular disadvantage in larger oil volumes. It is a different matter with parts which can present a source of faults, such as for example the magnetic valves, the number of which should be kept as low as possible, aiming to control several engine valve units, if possible, via just one solenoid.

In a known hydraulic valve control device of the generic type (DE-OS 35 11 820), a slide valve is controlled via a solenoid, this slide valve in turn controls the linkage between pressure chamber and reservoir. The solenoid is arranged close to the slide valve, because due to the design, the solenoid magnet is relatively distant from the engine valve. This leads to relatively long pipe runs, and an appropriately large volume of hydraulic oil between the reservoir and the pressure chamber.

ADVANTAGES OF THE INVENTION

The hydraulic valve control device has the advantage that the space provided in the pressure chamber for the cam piston spring, and hence detrimental space, is used as a reservoir, so that the dimensions of the valve control device do not have to be increased due to the integration of the reservoir piston, and that the hydraulic lines between the individual control areas within the valve control unit are minimised. Extra space for the reservoir in the area of the cylinder head is therefore no longer required. The control of the pressure channel between the pressure chamber and the reservoir area can be implemented in different ways, the important point being that this control is directly or indirectly implemented hydraulically. The hydraulic feed must be radial, since the cam piston is axially displaced in operation and requires a radial guide which can here be used for the feed of the control hydraulics by virtue of the fact that the guide can be bridged via an appropriate groove system in the surface area and the bore. A further advantage exists in the savings made during component manufacture. Since the cam piston and the reservoir piston are machined components running in precision bores, it is therefore sufficient to provide only one related precision bore in the cylinder head, as the other bore in the cam piston is machined on an automatic lathe.

One refinement of the invention consists of a solenoid which is triggered via an electronic control unit which processes engine parameters, for the control of the pressure line. Such a solenoid enables the high frequencies required for the control to be achieved without difficulty. Above all, it is possible to process via an electronic control unit all parameters conceivable and of interest, for the control of the engine valves. In principle, however, it is conceivable that the pressure line can be controlled via mechanical or hydromechanical means, with the reservoir piston as the core of the invention being arranged in the cam piston, which is designed as a tubular piston.

In accordance with a further advantageous refinement of the invention, the reservoir piston, as a moving part of the control valve, controls the connection between the pressure line and the reservoir, in which process a control line for hydraulic oil, fed under a definite control pressure radially to the cam piston, terminates in the reservoir, which may be controlled by a solenoid, and in which the spring force of the reservoir spring on the reservoir piston, is greater than the control force acting through the control pressure on the reservoir piston, but less than the actuating force of the reservoir piston, which is generated when the front face of the reservoir piston is loaded by the working pressure from the pressure chamber, when the cam follower is actuated by the driving cam in the opening direction. As soon as a control pressure has built up in the reservoir, due to the control pressure fed via the control line, the reservoir piston lifts off its seat so that, if the valve control unit is just being actuated by the driving cam, hydraulic oil will flow under working pressure into the reservoir and displace the reservoir piston, so that the valve piston which also restricts the pressure area remains in its position or, as the case may be, is pushed back to its starting position, in which the engine valve is again closed. The hydraulic oil volume being displaced on the one hand by the cam piston and on the other hand by the valve piston, is displaced via the pressure channel into the reservoir. As soon as the cam piston's intake stroke commences in accordance with the lift of the drive cam, the hydraulic oil returns from the reservoir to the pressure chamber, until the storage piston again rests on its valve seat. The upstroke control of the reservoir piston valve can be achieved either on the basis of distinct pressure conditions or of a pressure pulse, whereby due to the sudden infeed of control pressure via the control line, the reservoir piston lifts only slightly off its seat, subsequently being lifted further by the working pressure. If there happens to be no working pressure, because the drive cam is not active at that moment, then the reservoir piston will be immediately pushed back on its seat by the reservoir spring.

According to an advantageous refinement of the invention, the cam piston is arranged in a bore in the cylinder head for its radial guidance and is designed in a sleeve form with a division in the central area, in which the pressure line and/or the control line extend, with the reservoir piston in the sleeve part facing the driving cam and closed by a cap, being arranged axially displaceable and radially sealing, with its front face turned away from the reservoir spring, jointly with the division restricting the reservoir, whereby the driving cam engages on the one face of the cap, and the reservoir spring on its other face, and where in the sleeve section facing the engine valve, the valve piston is arranged which also seals radially, and together with the division, restricts the pressure chamber. In this way, a precision part exists which, on the one hand, radially seals to the outside, and on the other hand, also seals radially in the cavities, namely towards the reservoir piston, and also towards the valve piston. Apart from the fact that such a component can be readily and cheaply produced on an automatic lathe, it can also be mounted and replaced simply and quickly.

According to a further advantageous refinement of the invention, a non-return valve which opens towards the reservoir, is arranged in the control line, preferably in the control line's run in the cam piston sleeve division. Although a slide control would be equally conceivable, the non-return valve prevents any return flow of hydraulic fluid into the control line and, above all, it prevents hydraulic oil which flows under working pressure into the reservoir, from flowing into the control line. Even if there were a slide control or a choke instead of the non-return valve, it would be necessary to replace amounts of oil flowing into the control line in order to start with the same filling level situation at the cam piston's commencement of driving.

According to a further advantageous refinement of the invention, the hole in the cylinder head which accepts the cam piston has an annular groove, which is connected with the control line, this annular groove—in accordance with a special refinement—being connected with the reservoir via a relief channel, and the termination of this relief channel being blocked after a pre-stroke of the cam piston in its pressure stroke, while in the starting position of the cam piston the termination of the relief channel is open. The advantage being achieved thereby is that any residual amounts existing in the reservoir in the starting position of the cam piston, which prevent the reservoir piston from seating, can flow back into the control line via this relief channel and the annular groove. This does assume however, that the control line is pressure relieved at this instant, or that it has a pressure which is lower than the control pressure. In addition, this relief channel is also used as a top-up channel in order to obtain the same starting situation before the commencement of a new pressure stroke with the valve control unit.

According to a further advantageous refinement of the invention, the reservoir spring space which accepts the reservoir spring and is closed by a cap, is airtight, so that the air volume trapped within serves as a damper.

According to a further advantageous refinement of the invention, an annular groove exists in the area around the valve seat of the reservoir piston in the inner bore of the cam piston, which is restricted by the reservoir piston and connected with the pressure chamber by the pressure channel. Based on the shortness of the pressure channel, pressure losses or control deficiencies at high revolutions are therefore small due to the choke action.

According to a further advantageous refinement of the invention, a fluid source exists for the hydraulic oil (engine oil), which produces—via a pressure control valve—a control pressure fed via the control line, and in which a return flow line can be controlled to open by the solenoid, whereby the control pressure is degraded. As soon as the solenoid is closed, therefore, the control pressure can build up and slightly lift the reservoir piston off its seat, so that if this valve control unit happens to be actuated by the driving cam, the working pressure is transferred from the pressure chamber into the reservoir, with hydraulic oil flowing from the pressure chamber into the reservoir. In the intervals, while the return line is controlled open by the solenoid, hydraulic oil can flow from the reservoir back to the oil container, via the the relief channel.

According to a further advantageous refinement of the invention, a solenoid exists in the control line, which is controlled to open when required and allow hydraulic oil to flow under control pressure to the engine valve unit. This solenoid is preferably opened 'currentless', while the one in the return flow line is closed 'currentless'.

According to a further refinement of the invention intended for multicylinder internal combustion engines, in which a control line leads to each of the valve control units, several such control lines are controlled by only one solenoid in each case, with no time related overlaps of opening strokes occurring in their operation which is generated by the engine camshaft.

Further advantages and advantageous refinements of the invention can be found from the following description, the drawing, and the claims.

DRAWING

An embodiment of the subject of the invention is presented in the drawing and described hereafter in more detail.

FIG. 1 shows a longitudinal section through the valve control device of an engine inlet valve, with partial section through the associated engine outlet valve and the hydraulic circuit diagram associated with the control of the inlet valve, and FIG. 2 shows a control diagram of the hydraulic engine valve control for a 4-cylinder engine.

DESCRIPTION OF THE EMBODIMENT

Figure 1:
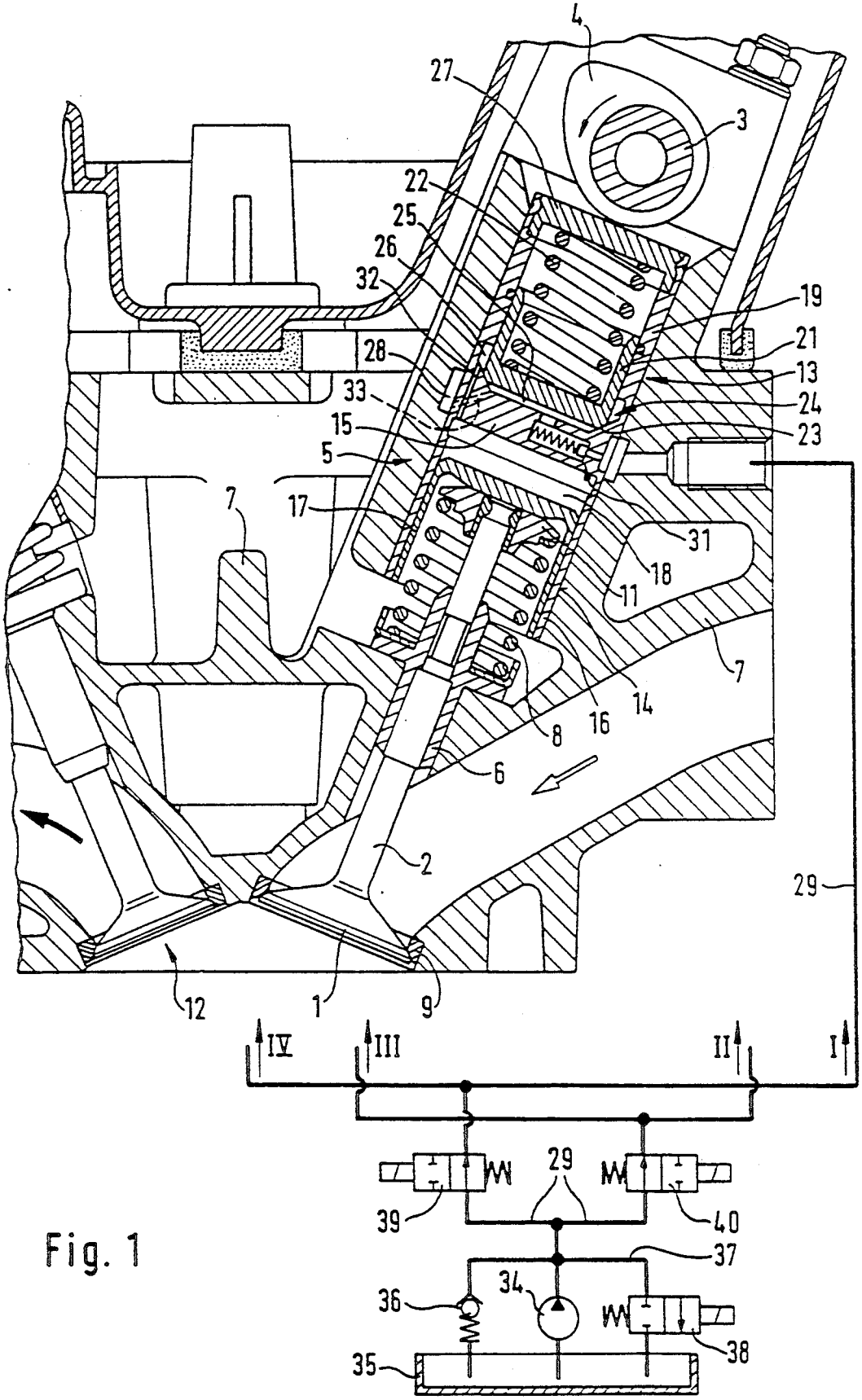

In the hydraulic valve control device represented in longitudinal section in FIG. 1, a controllable hydraulic cam follower 5 has been arranged between valve stem 2, which carries a valve disk 1 and a driving cam 4 which rotates with a camshaft 3. The valve stem is axially slideable in a bearing bush 6 of the cylinder head 7. A closing spring 8 presses the valve disk 1 on a valve seat 9, during which action the closing spring 8 rests at one end on a flange of the bearing bush 6 and at the other end on a spring disk 11, which is fixed to the end of the valve stem 2. In addition to this described inlet valve, an outlet valve is arranged in the cylinder valve head 7, this outlet valve being basically arranged in a similar manner, namely by a driving cam—not shown here—albeit with the difference that the cam follower arranged inbetween is not controllable.

The cam follower 5 has a sleeve shaped cam piston 13, which rests axially displaceable in a guide bore 14 of the cylinder head 7 and which has in its central area a division 15. This division 15 divides the cam piston 13 into two sleeve sections. In the sleeve section 16, a valve piston 17 operates as a radially sealing and axially displaceable component, which—placed over the spring disk 11—covers sections of the closing spring 8 and which, in addition to the restriction provided by division 15, restricts with its front face a restricted pressure chamber 18.

In the other sleeve section 19, the internal diameter of which is smaller than that of the sleeve section 16, a reservoir piston 21 is present which seals radially and which is axially displaceable which, loaded by a reservoir spring 22, acts jointly with its circular front flange edge 23 with a conical valve seat 24 arranged on the division 15. A reservoir 25 exists between the front face of the reservoir piston 21 and the side of the division 15 facing the said front face, the reservoir being separated by the circular front flange 23 or by the valve seat 24 from an annular groove 26 which is provided in the internal wall of the sleeve section 19. The reservoir spring 22 presses at one end against the base of the reservoir piston 21 and at the other end against a cap 27, by which the sleeve section 19 of the cam piston 13 is sealed airtight, by rolling-in, for example, and on which the driving cam 4 engages on the side facing away from the reservoir spring 22.

In the area of the division 15, a controlling annular groove 28 is provided in the guide bore 14, this groove being intersected by a control line 29, which terminates in the reservoir 25. In the section of the control line 29, which is situated between the controlling annular groove 28 and the reservoir 25, there is a non-return valve 31 which opens towards the reservoir 25. In addition, there is a pressure channel 32 in the division 15 which connects the annular groove 26 with the pressure chamber 18. There is furthermore a relief channel 33 in the division which connects the annular groove 28 with the reservoir 25 and which, after a definite stroke has been covered by the cam piston 13, is separated from the annular groove 28, so that this connection exists in the shown starting position between reservoir 25 and control line 29, but which is interrupted after the pressure stroke of the cam piston 13 has commenced.

The shown valve control device is supplied from a hydraulic system via a control line 29 by a feed pump 34 which draws in the hydraulic oil from an oil container 35 and feeds it to the control lines which lead to the individual hydraulically controlled cam followers 5, the number of which corresponds to that of the engine cylinders. The pressure in the control line 29 is controlled via a pressure control one-way valve 36. Branching off from the control line 29 is a return line 37 which returns to the oil container 35 and in which a 2/2 solenoid 38 is arranged which closes non-energised. The control line branches out twice in succession, with a 2/2 solenoid 39,40 being arranged after the first branching in each of the lines leading further and which solenoid opens non-energised, solenoid 39 opening the cam followers of engine cylinders I and IV, while the other solenoid 40 controls the cam followers of engine cylinders II and III simultaneously, as described in more detail in FIG. 2 below.

The engine valve control described in FIG. 1 works as follows: as long as the reservoir piston 21 with its circular front flange 23 rests on the valve seat 24, i.e. as long as no connection is possible via the pressure channel 32 between the pressure chamber 18 and the reservoir 25, the hydraulic cam follower acts as a rigid element, so that the stroke movement of the cam follower 13 which is generated by the driving cam 4 is immediately transferred to the valve stem 2 and hence to the valve disk 1. Due to the fact that the hydraulic oil enclosed in the pressure chamber 18 is quasi-incompressible, the valve piston 17 is operated synchronously with the cam piston 13 and this takes place in both directions. For this non-controlled operation, both solenoids 39,40 are energised, in the inhibiting position. All the hydraulic oil fed by the feed pump 34 flows back to the oil container 35 via the pressure retaining valve 36.

As soon as at least one of the solenoids 39,40 assumes the opening control position, the hydraulic oil pressure, via the control line 29, acts also in the reservoir 25 and causes the reservoir piston 21 to slightly lift off its valve seat 24. allowing hydraulic oil to flow from the annular groove 26 out of the pressure chamber 18 into the reservoir 25. Whenever due to a pressure stroke of the cam piston 13 caused by the working cam 4, there is in the pressure chamber 18 the working pressure which is effected mainly through the force of the closing spring, this pressure very quickly overcomes the force of the reservoir spring 22 and moves the reservoir piston 21. Due to this short-circuit between pressure chamber 18 and reservoir 25, the valve piston 17 is not moved, but remains in the shown position, in which the inlet valve with valve disk 1 is blocked. If this opening control by the control line 29 occurs at a time when the cam piston 13 has already covered a certain stroke and correspondingly moved the valve piston with the inlet valve, this sudden onset of control pressure in the control line 29 causes the reservoir piston 21 to lift off its valve seat 24, after which the opening stroke of the inlet valve is interrupted or, as the case may be, is again closed despite continuation of the pressure stroke of the cam piston 13. The hydraulic oil displaced from the pressure chamber 18 flows into the reservoir 25. During the subsequent intake stroke of the cam piston 13, the hydraulic oil will flow gradually from the reservoir 25 into the pressure chamber 18, until the reservoir valve from reservoir piston 21 and valve seat 24 is again closed. Surplus amounts can be fed back via the relief channel 33, thus ensuring that the reservoir piston 21 will in any event be seated before a new operating cycle commences. The non-return valve 31 prevents a return flow of fluid under reservoir pressure—or working pressure, in certain circumstances—into the control line 29.

Figure 2:
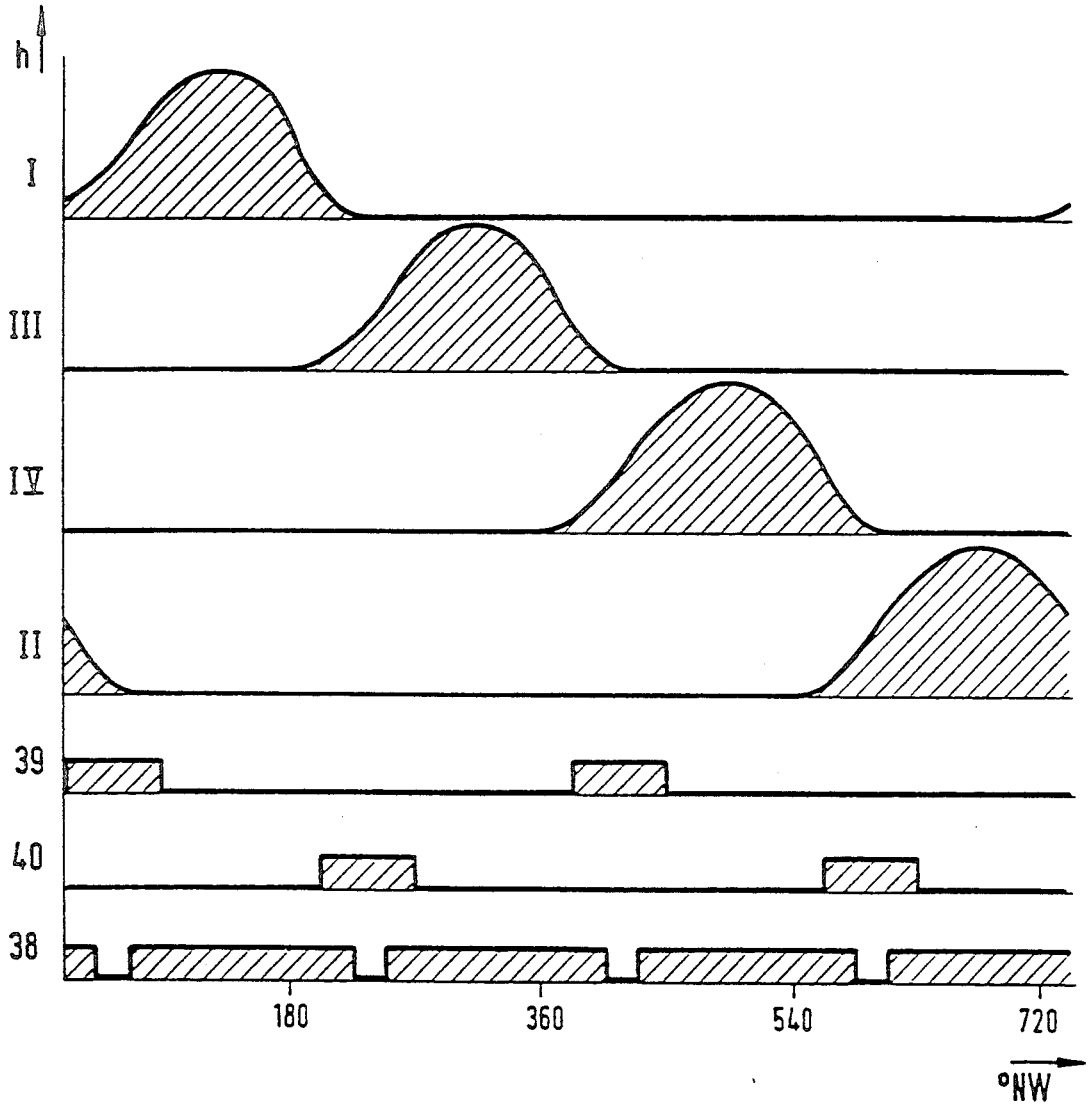

In the diagram shown in FIG. 2, the stroke of the engine valves or solenoids h (ordinates) is shown by the turning angle in °camshaft (abscissa). The ordinate presentation represents actually seven diagrams arranged one above another, in which the upper four diagrams I to IV are allocated to the cam followers of the corresponding engine cylinders, namely—seen from above—in the firing sequence of I, then III, then IV, and finally II, before the cam follower is once again actuated. The lowest diagram then corresponds to the solenoid 38, the next one above this corresponds to the solenoid 40, and the diagram above the latter corresponds to the solenoid 39.

As can be seen from the diagram associated with solenoid 38, the solenoid is always open, with interruptions. These interruptions occur just at the opening periods of solenoids 39 and 40. However, the control pressure from the control line 29 can only ever act when the solenoid 38 is blocked and one of the solenoids 39 or 40 is open. This control situation, i.e. control pressure in the control line 29, can only ever have an effect when the cam follower 5 which is just being driven, is actuated via the driving cam, so that the requisite working pressure for the control action can arise in the pressure chamber 18. This is apart from the fact that it is possible to control only that valve which happens to be actuated via the drive cam 4. By virtue of the fact that, for example, the solenoid 39 actuates simultaneously the control line 29 which leads to the engine valve I and IV, there is no overlapping with the cam followers III and II, for which at that particular time the solenoid 40 is blocked. The point in time from which the control is supposed to start, i.e. from which the pressure stroke is to be interrupted, depends on the overlapping of diagram 38 with one of the diagrams 39 and 40, the points in time being adjustable via the electronic control unit in relation to the engine characteristics.

All the features represented in the subsequent claims and the drawing can be significant to the invention both in isolation and in any combination with each other.

We claim:

1. A hydraulic valve control device for internal combustion engines having an engine camshaft, a cam drive and a cam follower, including an engine valve which is axially driven via said cam follower by the driving cam of said engine camshaft, a pressure chamber of variable volume, filled with hydraulic oil, which determines an effective length of the cam follower, said pressure chamber is restricted at one end by a cam piston actuated by said driving cam, and at the other end by a valve piston which acts on a valve stem, a fluid reservoir which is connectable via a pressure channel with the pressure chamber, and which has a spring loaded reservoir piston that restricts said fluid reservoir on a front face of said reservoir piston, and a control valve that controls fluid pressure to the pressure channel dependent on engine characteristics, said reservoir piston (21), reservoir spring (22), and reservoir (25) are arranged in the cam piston (13) which is configured as a hollow piston, the reservoir piston (21) is controlled by hydraulic means which is fed radially to the cam piston (13), and that the reservoir (25) is available between a piston floor of the cam piston (13) and the reservoir piston (21).

2. A hydraulic valve control device in accordance with claim 1, which includes a solenoid (39,40) for control of fluid under pressure to the pressure channel (32) this solenoid being driven via an electronic control unit which processes engine characteristics.

3. A hydraulic valve control device in accordance with claim 1, in which;

the reservoir piston (21) as a moving valve part controls a connection between the pressure channel (32) and the reservoir (25), a control line (29) for hydraulic oil, which is radially fed to the cam piston (13) under a definite control pressure, terminates in the reservoir (25) and which is solenoid controlled in appropriate circumstances, and a spring force acting through the reservoir spring (22) on the reservoir piston (21) is smaller than an actuating force which acts through the control pressure on the reservoir piston (21) and which is generated when the front face of the reservoir piston (21) is loaded by working pressure from the pressure chamber (25) for as long as the cam follower (5) is actuated by the driving cam (4) in an opening direction.

4. A hydraulic valve control device in accordance with claim 2, in which;

the reservoir piston (21) as a moving valve part controls a connection between the pressure channel (32) and the reservoir (25), a control line (29) for hydraulic oil, which is radially fed to the cam piston (13) under a definite control pressure, terminates in the reservoir (25) and which is solenoid controlled in appropriate circumstances, and a spring force acting through the reservoir spring (22) on the reservoir piston (21) is smaller than an actuating force which acts through the control pressure on the reservoir piston (21) and which is generated when the front face of the reservoir piston (21) is loaded by working pressure from the pressure chamber (25) for as long as the cam follower (5) is actuated by the driving cam (4) in an opening direction.

5. A hydraulic valve control device in accordance with claim 3, in which;

said cam piston (13) is guided radially and arranged axially movable in a guide bore (14) of a cylinder head (7) and is of sleeve-type construction, with a intermediate cylinder division (15) present in a central area, in which the pressure channel (32) and the control line (29) are connected to each other, said cam piston includes a sleeve section (19), which faces the driving cam (4) and which is sealed by a cap (27), the reservoir piston (21) is arranged axially movable and radially sealing within said cam piston, which together with the intermediate division, restricts the reservoir (25) with its front face turned away from the reservoir spring (22), cap 27 is engaged on one side of the cap (27) by the driving cam (4) and on the other side by a reservoir spring (22) in a reservoir space, and the valve piston (17) is arranged in a sleeve section (16) which faces an engine valve (1,2) and, radially sealing and axially moving with the intermediate cylinder division (15), restricts the pressure chamber (18).

6. A hydraulic valve control device in accordance with claim 4, in which;

said cam piston (13) is guided radially and arranged axially movable in a guide bore (14) of a cylinder head (7) and is of sleeve-type construction, with a intermediate cylinder division (15) present in a central area, in which the pressure channel (32) and the control line (29) are connected to each other, said cam piston includes a sleeve section (19), which faces the driving cam (4) and which is sealed by a cap (27), the reservoir piston (21) is arranged axially movable and radially sealing within said cam piston, which together with the intermediate division, restricts the reservoir (25) with its front face turned away from the reservoir spring (22), cap 27 is engaged on one side of the cap (27) by the driving cam (4) and on the other side by a reservoir spring (22) in a reservoir space, and the valve piston (17) is arranged in a sleeve section (16) which faces an engine valve (1,2) and, radially sealing and axially moving with the intermediate cylinder division (15), restricts the pressure chamber (18).

7. A hydraulic valve control device in accordance with claim 3, in which a one-way valve (31) which opens towards the reservoir (25) is arranged in the control line (29), in appropriate circumstances in the intermediate cylinder division (15).

8. A hydraulic valve control device in accordance with claim 4, in which a one-way valve (31) which opens towards the reservoir (25) is arranged in the control line (29), in appropriate circumstances in the intermediate cylinder division (15).

9. A hydraulic valve control device in accordance with claim 5, in which a one-way valve (31) which opens towards the reservoir (25) is arranged in the control line (29), in appropriate circumstances in the intermediate cylinder division (15).

10. A hydraulic valve control device in accordance with claim 5, in which a controlling annular groove (28) exists in the guide bore (14) of the housing head (7) which accepts the cam piston (13), which groove (28) is connected with the control line (29).

11. A hydraulic valve control device n accordance with claim 7, in which a controlling annular groove (28) exists in the guide bore (14) of the housing head (7) which accepts the cam piston (13), which groove (28) is connected with the control line (29).

12. A hydraulic control device in accordance with claim 10, in which the control annular groove (28) is connected with the reservoir (25) via a relief channel (33) and that the termination of the relief channel (33) is blocked and controlled after a pre-stroke travel of the cam piston (13), by the restriction of the controlling annular groove (28), with the pressure stroke of the cam piston, whereas the relief channel is controlled to open in the starting position of the cam piston.

13. A hydraulic valve control device in accordance with claim 5, in which the reservoir spring space is sealed airtight.

14. A hydraulic valve control device in accordance with claim 10, in which the reservoir spring space is sealed airtight.

15. A hydraulic valve control device in accordance with claim 12, in which the reservoir spring space is sealed airtight.

16. A hydraulic valve control device in accordance with claim 5, in which there is an annular groove (26) is an area around a valve seat (24) of the reservoir piston (21) in the internal bore of the cam piston (13) which is restricted by the reservoir piston (21) and linked to the pressure chamber (18) by the pressure channel (32).

17. A hydraulic valve control device in accordance with claim 7, in which there is an annular groove (26) in an area around a valve seat (24) of the reservoir piston (21) in the internal bore of the cam piston (13) which is restricted by the reservoir piston (21) and linked to the pressure chamber (18) by the pressure channel (32).

18. A hydraulic valve control device in accordance with claim 10, in which there is an annular groove (26) in an area around a valve seat (24) of the reservoir piston (21) in the internal bore of the cam piston (13) which is restricted by the reservoir piston (21) and linked to the pressure chamber (18) by the pressure channel (32).

19. A hydraulic valve control device in accordance with claim 12, in which there is an annular groove (26) in an area around a valve seat (24) of the reservoir piston (21) in the internal bore of the cam piston (13) which is restricted by the reservoir piston (21) and linked to the pressure chamber (18) by the pressure channel (32).

20. A hydraulic valve control device in accordance with claim 5, in which a fluid source (34) for hydraulic oil is provided which generates a control pressure which is controlled by a pressure control valve (36) which is fed via the control line (29) and that a return line (37) can be controlled to open through a solenoid (38), through which the control pressure can be degraded.

21. A hydraulic valve control device in accordance with claim 6, in which a fluid source (34) for hydraulic oil is provided which generates a control pressure which is controlled by a pressure control valve (36) which is fed via the control line (29) and that a return line (37) can be controlled to open through a solenoid (38), through which the control pressure can be degraded.

22. A hydraulic valve control device in accordance with claim 7, in which a fluid source (34) for hydraulic oil is provided which generates a control pressure which is controlled by a pressure control valve (36) which is fed via the control line (29) and that a return line (37) can be controlled to open through a solenoid (38), through which the control pressure can be degraded.

23. A hydraulic valve control device in accordance with claim 10, in which a fluid source (34) for hydraulic oil is provided which generates a control pressure which is controlled by a pressure control valve (36) which is fed via the control line (29) and that a return line (37) can be controlled to open through a solenoid (38), through which the control pressure can be degraded.

24. A hydraulic valve control device in accordance with claim 12, in which a fluid source (34) for hydraulic oil is provided which generates a control pressure which is controlled by a pressure control valve (36) which is fed via the control line (29) and that a return line (37) can be controlled to open through a solenoid (38), through which the control pressure can be degraded.

25. A hydraulic valve control device in accordance with claim 20, in which said control line (29) is provided with a solenoid which can be controlled to open as required.

26. A hydraulic valve control device for a multi-cylinder internal combustion engine in accordance with claim 20, in which said control line (29) leads to each of the valve control units (cam follower 5) and that several such control lines (29) can be controlled by only one solenoid (39,40) at any time.

27. A hydraulic valve control device for a multi-cylinder internal combustion engine in accordance with claim 25, in which said control line (29) leads to each of the valve control units (cam follower 5) and that several such control lines (29) can be controlled by only one solenoid (39,40) at any time.

* * * * *